United States Patent [19]

Silverberg

[11] Patent Number: 4,775,142

[45] Date of Patent: Oct. 4, 1988

[54] ROLLER APPARATUS FOR SIDE REGISTRATION OF DOCUMENTS

[75] Inventor: Morton Silverberg, Westport, Conn.

[73] Assignee: Pitney Bowes Inc., Stamford, Conn.

[21] Appl. No.: 19,098

[22] Filed: Feb. 26, 1987

[51] Int. Cl.[4] ..... B65H 9/16

[52] U.S. Cl. ..... 271/251; 271/274

[58] Field of Search ..... 271/250, 251, 272, 274, 271/248

[56] References Cited

U.S. PATENT DOCUMENTS

| | | | |
|---|---|---|---|
| 2,894,744 | 7/1959 | Schulze | 271/272 |
| 2,995,364 | 8/1961 | Frederick et al. | 271/52 |
| 3,072,397 | 1/1963 | Kelchner | 271/274 |
| 3,148,877 | 9/1964 | Brearley | 271/251 |
| 3,929,327 | 12/1975 | Olson | 271/272 |
| 3,964,739 | 6/1976 | Garcia | 271/250 |
| 4,179,117 | 12/1979 | Rhodes, Jr. | 271/251 |
| 4,270,443 | 6/1981 | McSwiney et al. | 271/251 |
| 4,394,009 | 7/1983 | Bergman et al. | 271/10 |
| 4,426,073 | 1/1984 | Mizuma | 271/251 |

FOREIGN PATENT DOCUMENTS

| | | | |
|---|---|---|---|
| 60-102351 | 6/1985 | Japan | 271/248 |
| 254259 | 10/1929 | United Kingdom | 271/49 |

*Primary Examiner*—H. Grant Skaggs

*Attorney, Agent, or Firm*—Lawrence E. Sklar; David E. Pitchenik; Melvin J. Scolnick

[57] ABSTRACT

In a document processing machine, apparatus for urging documents against a registration fence while simultaneously driving the documents along a conveying path determined by the fence. The apparatus includes a housing frame, a registration fence secured to the frame, a deck secured to the frame for receiving the documents seriatim, a pair of cooperating rollers rotatably mounted on the frame, the rollers having crossed axes, one of the rollers being mounted in perpendicular relationship to the fence, and capability for driving the one roller. The one roller includes an elastomeric covering having disk portions separated by grooves the disk portions being radially segmented to thereby form individual petals. The other of the pair of rollers is resiliently biased against the one roller, thereby exerting a normal force acting toward the one roller to provide resultant component frictional forces for causing lateral and longitudinal movement of the document along the fence.

5 Claims, 3 Drawing Sheets

ROLLER APPARATUS FOR SIDE REGISTRATION OF DOCUMENTS

BACKGROUND OF INVENTION

The instant invention relates to rollers for effecting registration of documents and more particularly to apparatus for registration of documents such as mail envelopes against a registration fence for the purpose of alignment of the envelopes prior to further processing at a downstream location.

The present invention overcomes the problems of the prior art caused by the requirement that mailing machines handle varying thicknesses of envelopes seriatim without damaging those envelopes prior to downstream processing. The prior art does not afford a solution which would allow an envelope processing machine to handle envelopes varying in dimensional parameters and weight ranging from tissue-like air mail envelopes to envelopes weighing two or more ounces without causing some kind of damage to the lighter weight envelopes. There is, for example, a tendency for the air mail envelopes to crumple or collapse when conveyed through the devices of the prior art.

By using a novel combination of rollers described hereinafter which causes positive, but gentle registration of the envelopes while simultaneously providing a strong, forward drive in the longitudinal direction, the aforementioned problems are obviated.

SUMMARY OF THE INVENTION

Accordingly, the instant invention provides, in a document processing machine, apparatus for urging documents against a registration fence while simultaneously driving the documents along a conveying path which is determined by the fence. The apparatus includes a housing frame, a registration fence secured to said frame, a deck secured to the frame for receiving the documents seriatim, a pair of cooperating rollers rotatably mounted on the frame, the rollers having crossed axes, one of said rollers being mounted in perpendicular relationship to the fence, and means for driving said one roller. The one roller includes an elastomeric covering having disk portions separated by grooves, the disk portions being radially segmented to thereby form individual petals. The other of the pair of rollers is resiliently biased against the one roller and oriented at an acute angle to the one roller, thereby exerting a normal force acting toward the one roller to provide resultant component frictional forces for causing lateral and longitudinal movement of the document along the fence.

DESCRIPTION OF THE PREFERRED EMBODIMENT

Figure 1:
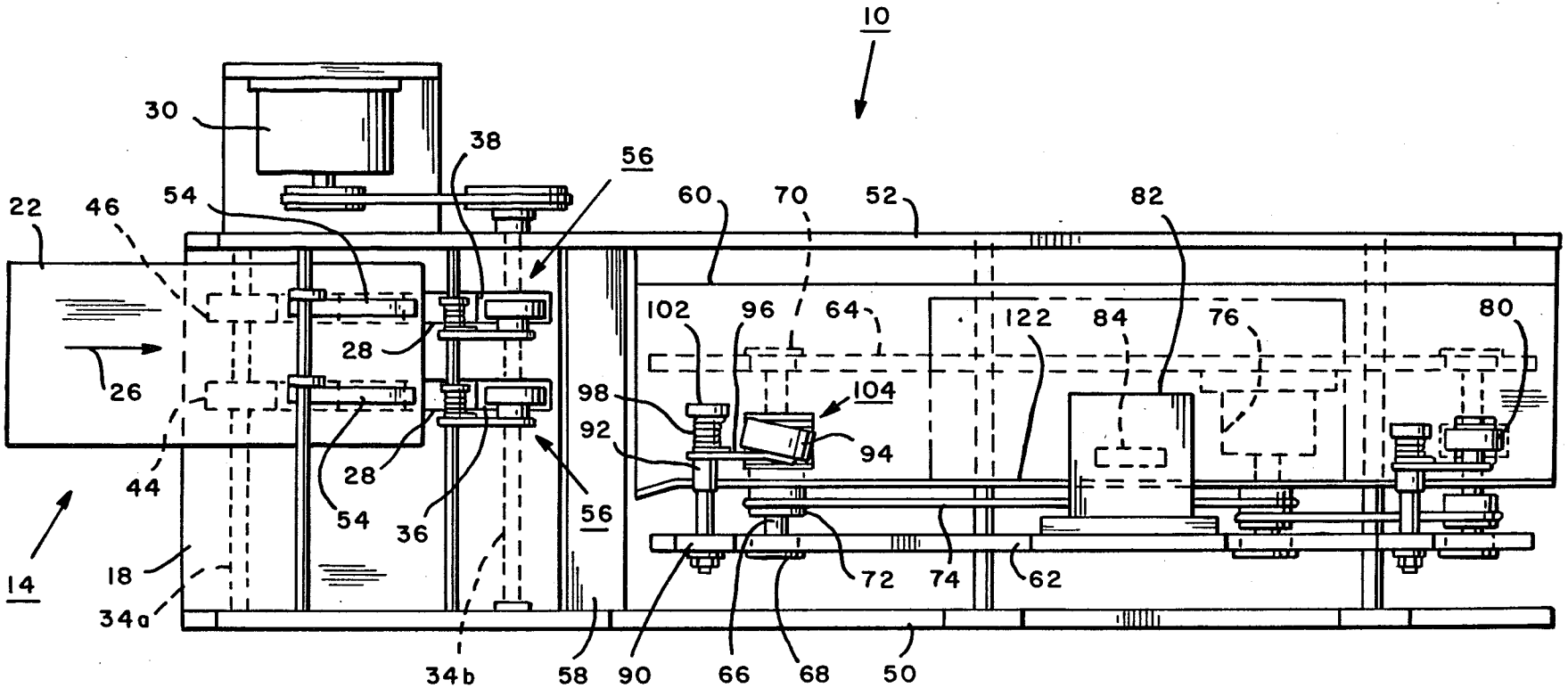
FIG. 1 is a top, plan view of a document processing apparatus in accordance with the instant invention.

In describing the preferred embodiment of the instant invention, reference is made to FIG. 1 wherein there is seen a document processing apparatus generally designated 10 which will be described hereinafter in an environment of a machine for feeding mail envelopes seriatim and then printing upon the envelopes at a downstream location. The present invention may also be used with a mailing machine and postage meter.

Figure 2:
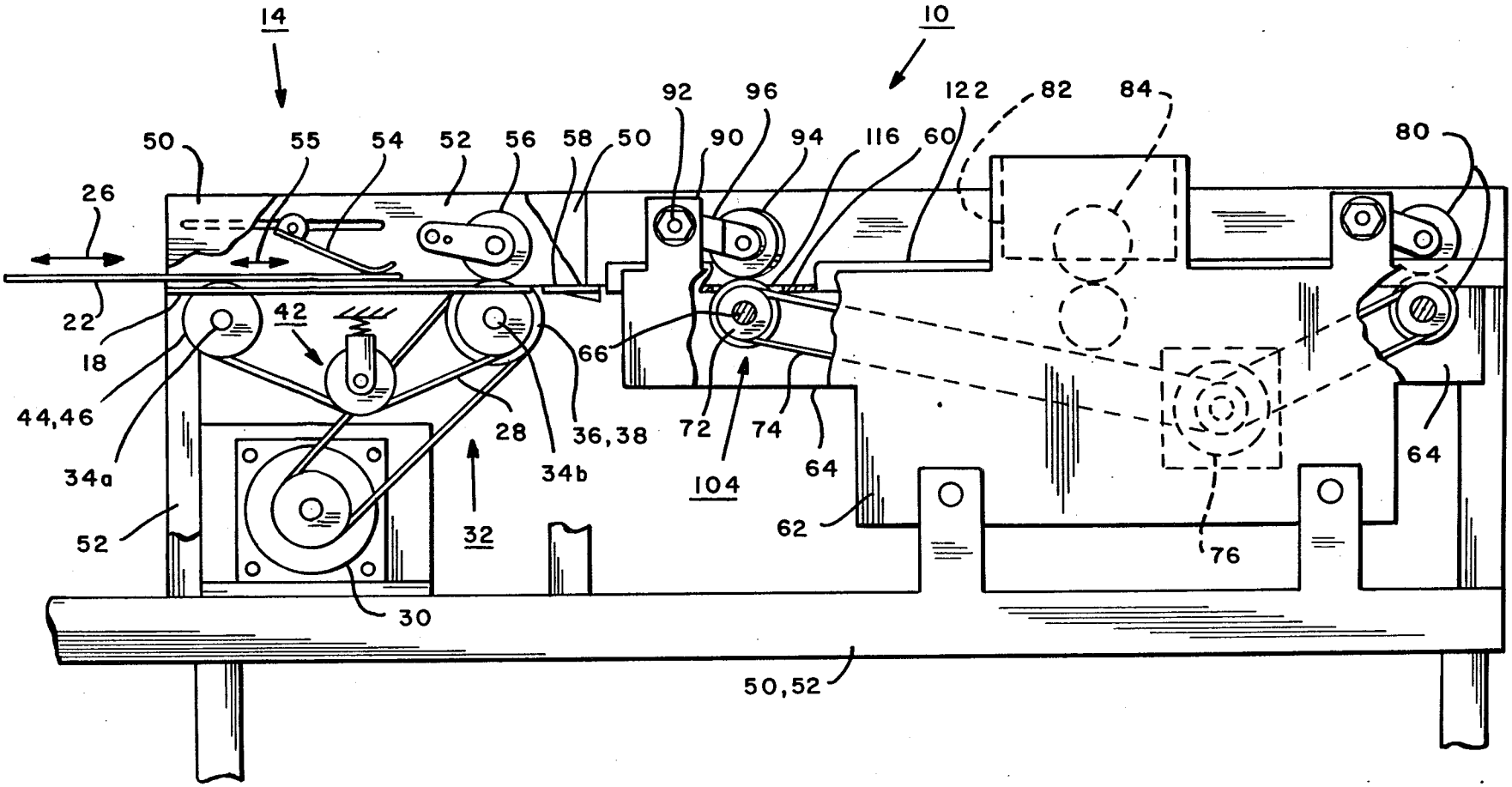
FIG. 2 is a front, elevational view of the apparatus seen in FIG. 1.

The apparatus 10 includes an input station 14 having an in-feed hopper deck 18 for supporting an envelope 22 which is fed along a feed path 26 from an upstream processing apparatus (not shown). In a typical application, the envelope 22 is received from an inserting mahine such as that described in U.S. Pat. No. 4,524,557 issued June 25, 1985 to Silverman et al. The input station 14 has a frame and structure which supports the deck 18 and a drive motor 30 (FIG. 2) which is connectively engaged to a conveying assembly 32 having a pair of conveying belts 28. A pair of pulleys 44 and 46 mounted on a shaft 34*a* support the input side of the belts 28 receiving the envelopes 22. The deck 18 forms a structural support mounted between a front frame 50 and a rear frame 52 (FIG. 1), so that the belts 28 may rest upon the deck 18. The belts 28 are tensioned by a roller assembly 42.

A pair of pressure members 54 are adjustable in a longitudinal direction 55 as required to accommodate varying lengths of envelopes 22 being fed into the station 14. A pressure roller 56 provides a normal force to the belts 28, the roller 56 being located directly over a pair of pulleys 36 and 38 mounted on a shaft 34*b*. All of the preceding connecting drive and belting apparatus provide sufficient drive to propel the envelopes 22 forward to a bridge member 58, which allows each envelope 22 to be guided to a deck 60.

The apparatus 10 further includes front and rear auxiliary frames 62 and 64 respectively which are supported within the apparatus 10, as are the frames 50 and 52. A shaft 66 is rotatably supported in bearings 68 and 70. An "O" ring pulley 72 is fastened to the shaft 66, and an "O" ring drive belt 74 is mounted on the pulley 72 for driving the shaft 66. A drive motor 76 is mounted on the frame 64 to drive the belt 74 and a pair of downstream rollers 80. The apparatus 10 further includes a printing device 82 having a rotatable printing drum 84 for imprinting an indicia on each envelope 22 fed through the apparatus 10.

Figure 3:
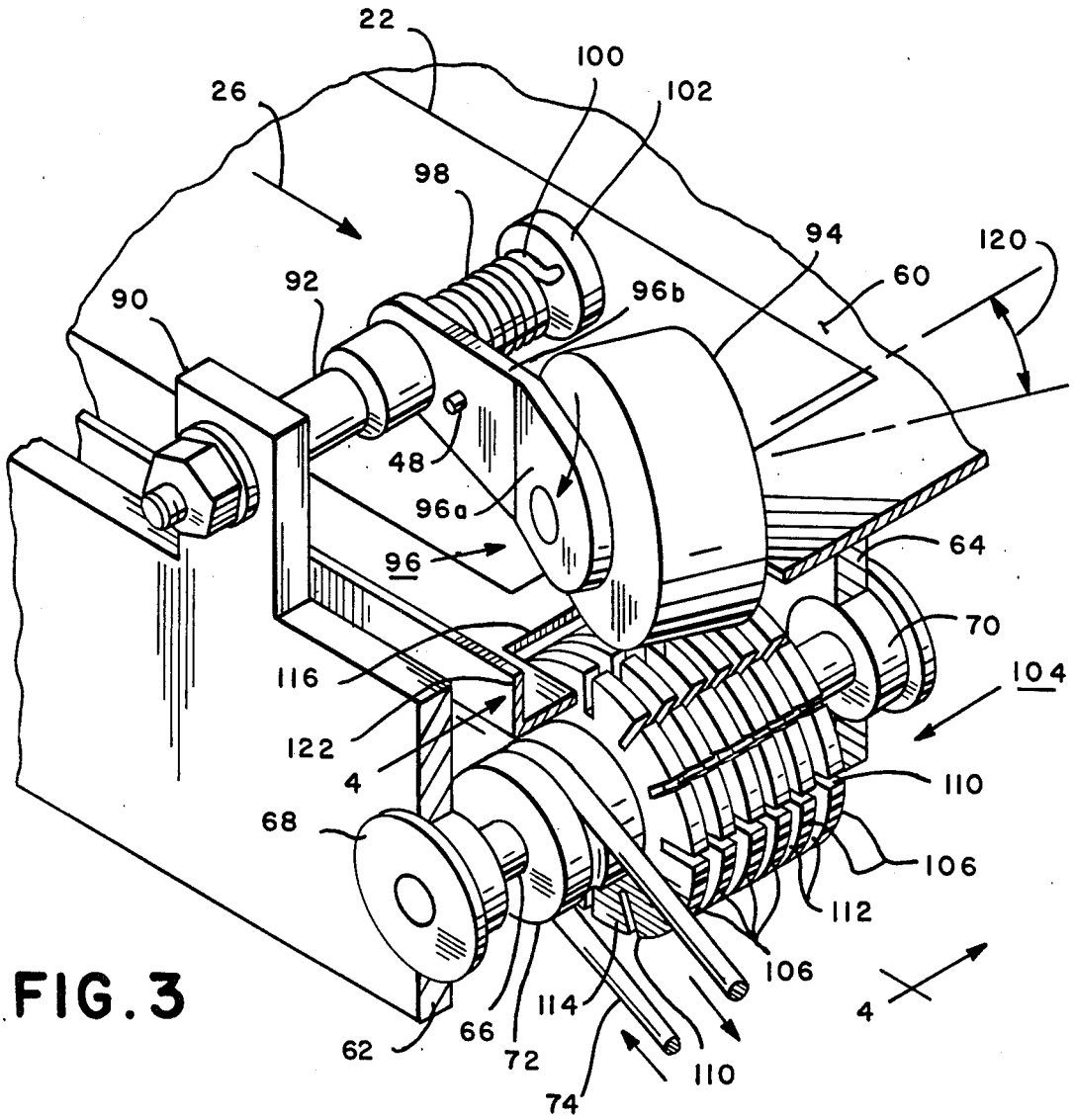
FIG. 3 is an enlarged, isometric view of the roller apparatus of the present invention.

Referring now to FIG. 3, the frame 62 includes an upstanding leg 90 which receives and rigidly holds a laterally, rearwardly extending stud 92. A roller 94 is mounted on a pivotable lever arm 96, and a torsion spring 98 is appropriately attached to the arm 96 at an aperture 48, while an opposite end 100 of the spring 98 is secured to a flange 102 of the stud 92. A resultant clockwise moment is therefore applied to the roller 94, and a normal force is applied to an elastomeric roller cover 104 which is secured to shaft 66 by conventional means such as vulcanizing. The arm 96 has an end portion 96*a* which is bent at about a 15 degree angle with respect to its major portion 96*b* which is substantially parallel to the path 26 and the frames 50 and 52. The result is that the axis of the roller 94 is oriented at about 15 degrees with respect to the axis of the shaft 66 and roller cover 104. It should be noted that either of the rollers 104 and 94 may be the driven roller and the other the idler roller.

Figure 4:
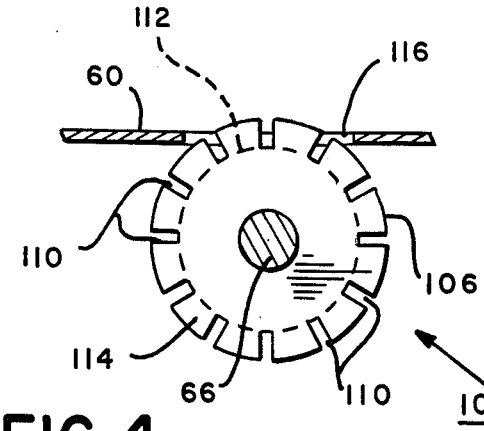
FIG. 4 is an enlarged, sectional view taken on the plane indicated by the line 4—4 of FIG. 3, showing a section of the lower, drive roller.
Figure 5:
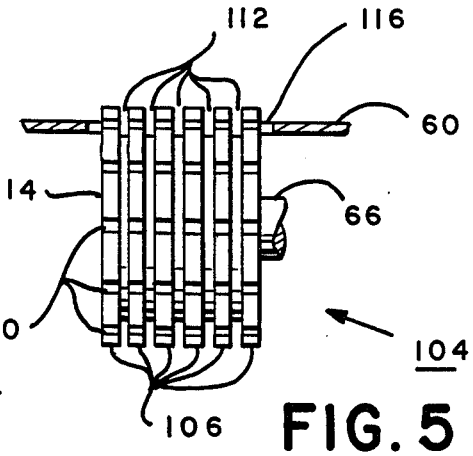
FIG. 5 is an enlarged, side elevational view of the roller seen in FIG. 4.

The roller cover 104 is divided into six disks 106 separated by five lateral grooves 112 uniformly spaced across the width of the cover 104 to permit lateral deflection thereof. The grooves 112 are spaced apart 0.250 inches, but it will be understood that they may be spaced at other dimensions as would suit the specific application. It is seen in FIG. 4 that there are also radial slots 110 which divide each of the disks 106 into radial segments 114 equally about their circumference. The radial segments 114 resemble flower petals which easily bend laterally when so influenced. The slots 110 and the grooves 112 do not extend to the shaft 66, but their depths may be varied in accordance with the requirements of the particular application. The deck 60 (FIG. 3) includes an appropriate cutout 116, which enables the upper portion of the roller 104 to protrude slightly above the surface of the deck 60, thereby easily engaging the envelope 22, which is guided along the deck 60.

It will be noted that the roller 94 is mounted at a skewed angle 120 with respect to the roller 104 and its shaft 66. It has been found that an angle 120 of about 15 degrees is best for the purpose of handling the varying thicknesses and weights of mail envelopes, including air mail envelopes. It has also been found that when the number of slots 110 are increased from the six shown to eight that the side registration action upon the envelopes 22 was dramatically increased. The individual width of each disk 106 has been found to be somewhat critical in the mailing applications. However, the spacing of the radial slots 110 within each disk 106 has been found to be the most critical variable. Preferably, for mail envelopes, the disk 106 should be 0.093 inch wide, the width of the grooves 112 should be 0.030 inch, and the width of the radial slot 110 should be 0.062 inch. It will be recognized by those skilled in the art that the relative sizes of the rollers, the pressure rollers, the skew angle, the spacings of the radial slots and the grooves separating the disks will all be instrumental in using the instant invention in other applications.

The roller 94 is covered by a low friction material which limits lateral forces while allowing high forward (longitudinal) drive forces to occur from the lower roller 104. The roller 104 is elastomeric and thereby resilient in nature, and therefore deflection of the disks 106 occurs easily. The combination of the two rollers 94 and 104 as described enables even the most weakly constructed envelopes, such as air mail envelopes, to be registered against a registration fence 122 without collapsing. Those skilled in the art will understand the nature of handling such envelopes which are flimsy and otherwise hard to handle. The present device easily accommodates these types of envelopes due to the foregoing combination of components. It will be understood by those skilled in the art that there could be a series of skewed roller 94 and 104. The serial arrangement could be utilized to achieve a more gradual registration of envelopes over a longer period of time and greater distance, and could assure the requisite registration for downstream processing.

Therefore, having shown and described the fundamental novel features of the invention as applied to a preferred embodiment, it will be understood that various omissions and substitutions or changes made in the form and details of the device illustrated and described in operation may be made by those skilled in the art without departing from the spirit of the invention.

What is claimed is:

1. In a document processing machine, apparatus for urging documents against a registration fence while simultaneously driving said documents along a conveying path determined by said fence, said apparatus comprising:

a housing frame;

a registration fence secured to said frame;

a deck secured to said frame for receiving said documents seriatim;

a pair of cooperating rollers rotatably mounted on said frame, said rollers having crossed axes, one of said rollers being mounted in perpendicular relationship to said fence;

means for driving said one roller, said one roller having an elastomeric covering with disk portions separated by grooves, said disk portions being radially segmented to thereby form individual petals, the other of said pair of rollers being resiliently biased against said one roller and oriented at an acute angle to said one roller, thereby exerting a normal force toward said one roller to provide resultant component frictional forces for causing lateral and longitudinal movement of said document along the fence, said one roller able to withstand said normal force and to permit said documents to move laterally regardless of the amount of said normal force.

2. The apparatus of claim 1, wherein said one roller comprises the bottom roller.

3. The apparatus of claim 1, wherein said other roller is oriented at an angle of about 15 degrees to said one roller.

4. The apparatus of claim 3, wherein said one roller includes six disks separated by five grooves.

5. The apparatus of claim 4, wherein each of said disk portions includes eight petals.

* * * * *